US005685817A

United States Patent [19]

Feldkämper

[11] Patent Number: 5,685,817

[45] Date of Patent: Nov. 11, 1997

[54] ARRANGEMENT FOR THE SCORING OF CONTINUOUSLY TRANSPORTED, FLAT WORKPIECES TO BE FOLDED ALONG SCORED LINES

[75] Inventor: Richard Feldkämper, Lengerich, Germany

[73] Assignee: Windmöller & Hölscher, Lengerich, Germany

[21] Appl. No.: 665,955

[22] Filed: Jun. 19, 1996

[30] Foreign Application Priority Data

Jul. 4, 1995 [DE] Germany ..... 195 24 328.5

[51] Int. Cl.[6] ..... B31B 1/25

[52] U.S. Cl. ..... 493/241; 493/370; 493/475; 83/342; 83/886

[58] Field of Search ..... 493/56, 59, 60, 493/64, 65, 66, 86, 160, 161, 194, 199, 223, 224, 227–230, 240–242, 340, 354, 355, 365–372, 468, 471, 473, 475; 83/342, 672, 885, 886, 887

[56] References Cited

U.S. PATENT DOCUMENTS

| | | | |
|---|---|---|---|
| 371,579 | 10/1887 | Harding | 83/342 |
| 1,196,912 | 9/1916 | Weck | 83/885 |
| 1,935,522 | 11/1933 | Prior | 83/886 |
| 2,172,359 | 4/1939 | Campbell | 83/342 |
| 2,224,668 | 12/1940 | Christian | 83/342 |
| 2,393,586 | 1/1946 | Bruker | 493/354 |
| 3,190,163 | 6/1965 | Bradley | 83/342 |
| 3,491,632 | 1/1970 | Dovey | 83/885 |
| 3,570,337 | 3/1971 | Morgan | 83/342 |
| 3,821,911 | 7/1974 | Seme | 83/885 |
| 4,493,235 | 1/1985 | Martin | 83/342 |
| 4,846,778 | 7/1989 | Hirakawa et al. | 83/885 |
| 4,881,436 | 11/1989 | Rommel | 83/342 |
| 5,378,221 | 1/1995 | Lauderbaugh et al. | 493/354 |

FOREIGN PATENT DOCUMENTS

| | | |
|---|---|---|
| 19 64 069 | 7/1967 | Germany . |
| 1964069 | 7/1967 | Germany . |

OTHER PUBLICATIONS

AD 2366/AD 2368, Windmöller & Hölscher.

*Primary Examiner*—Joseph J. Hail, III
*Assistant Examiner*—Darren Ark
*Attorney, Agent, or Firm*—Keck, Mahin & Cate

[57] ABSTRACT

An arrangement for scoring continuously transported flat workpieces to be folded along scored lines is composed of scoring tools fastened to shafts that are parallel to each other. One part of the scoring tools features a groove and the other part features a ridge. The groove and the ridge follow a helical path over external cylinders defined by the tools and engage with each other in the contact region of their cover lines. In order to set lengths of the scored lines, a tool part is composed of a package of tightly compact, discoid segments that carry the scoring tools. At least one part of these segments can be retained on the shaft in a manner permitting rotation, and located at different angles, in order to be able to form two scored lines with only one pair of scoring rolls. A cylindrical saucer-type segment forming a second scoring tool is retained on each shaft. One of the cylindrical saucer-type segments is provided with a helical ridge and the other cylindrical saucer-type segment is provided with a helical groove. The helical ridge and the helical groove engage with each other in the contact region of their cover lines of the external cylinder defined by the same.

5 Claims, 7 Drawing Sheets

FIG. 1
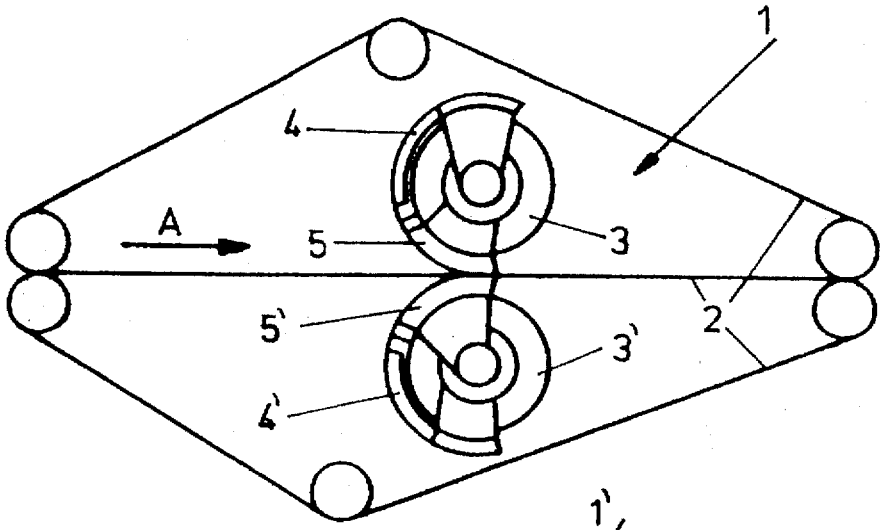
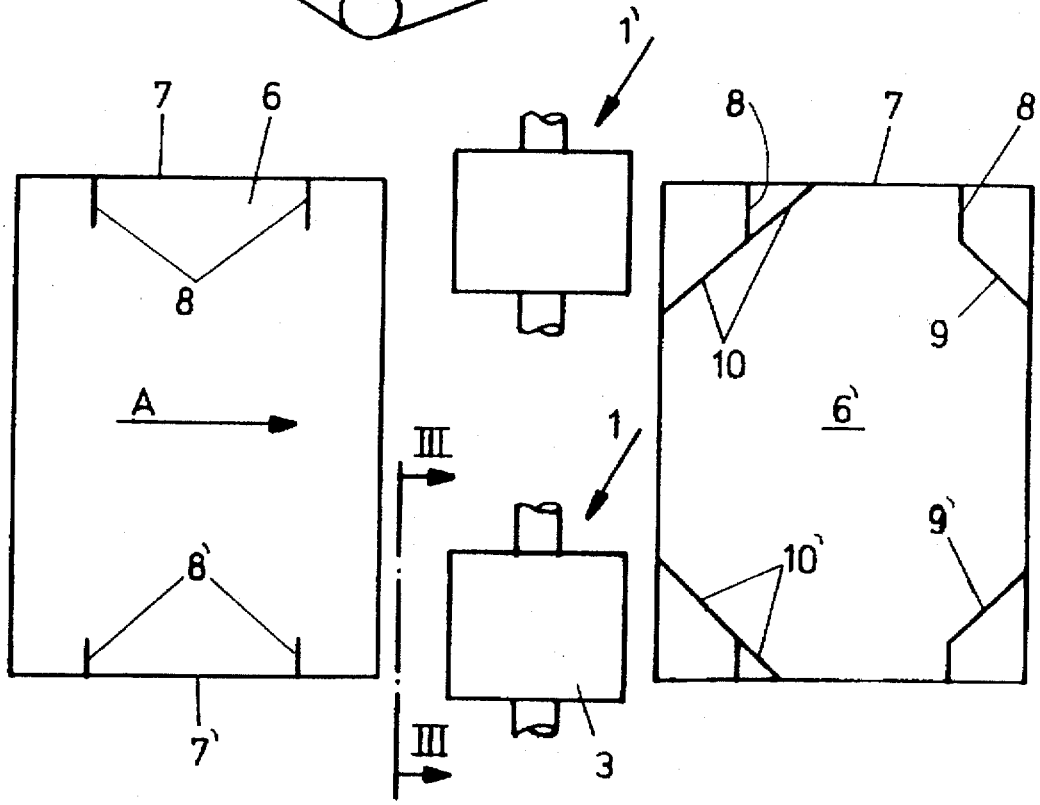
FIG. 2

ARRANGEMENT FOR THE SCORING OF CONTINUOUSLY TRANSPORTED, FLAT WORKPIECES TO BE FOLDED ALONG SCORED LINES

BACKGROUND OF THE INVENTION

1. Field of the Invention:

This invention pertains to an arrangement for scoring continuously transported, flat workpieces to be folded along scored lines, preferably in order to provide tubular pieces with prefold lines in a diagonal path in order to prepare the folds of cross bottoms to be attached thereto. The arrangement is composed of scoring tools fastened to shafts that are parallel to each other. The scoring tools have one part composed of a groove (female mold) and the other part composed of a ridge (male mold), which take a helical path over the external cylinder described by the same and which engage with each other in the contact region of their surface lines. In order to set the length of the scoring lines, or prefold lines, a part of the tool is composed of packages of tightly fitting discoid or plate-type segments that carry the scoring tools. At least one of the segments is retained on the shaft in a pivoting manner and can be fixed at different angles.

2. Description of Related Art:

A scoring arrangement for the provision of diagonal scorings at the ends of flat-lying tubular pieces in paper bag manufacture is known from DE-GM 1,964,069. Diagonal scorings, in this arrangement, form the prefold lines for cross bottoms to be attached to the tubular pieces. In this known arrangement, two segments, respectively, which carry scoring tools, are clamped to each of two shafts that are parallel to each other. The angle of the segments can be changed with respect to each other such that when adapting to different formats, both diagonal scorings can be respectively provided at the ends of the tubular pieces in one station.

In order to widen lateral tucks to be partially folded over the corner tucks, composed of triangular pockets of bottom squares that have been drawn up, it is common to provide the cut ends of tubular pieces with two incisions that are parallel to each other. If diagonal scorings are executed over these incisions, then the triangular pieces, partitioned off by the scorings, have a tendency to fold upward around the scored lines such that the forward triangular pieces form hems that obstruct a perfect further processing and can lead to disruptions of the operation. In order to avoid this type of disturbance, it is necessary to execute a diagonal scoring, on the forward side of a tubular piece transported in a transverse sense, which starts from the forward edge of the fold and goes to only to the point of the incision. In this way, a scored line that partitions off a triangular piece is avoided.

With arrangements known from DE-GM 1,964,069, the length of diagonal scorings cannot adapt to incisions that widen lateral flaps of the bottom.

An arrangement of the aforementioned type is known from a brochure by Windmöller & Hölscher company, "AD 2366/AD 2368" (with printing note: 15/82/987/T 1,5). In this arrangement, however, a pair of scoring rolls is provided for each of the two prefold lines having a diagonal path, to be provided at one end of a tubular piece. In this known arrangement, the length of scored lines can be set by twisting and fixing of segments that carry the scoring tools. This known arrangement, however, is costly inasmuch as two pairs of scoring rolls, respectively, must be provided in order to provide the two diagonal scorings at the ends of the tubular pieces.

SUMMARY OF THE INVENTION

The purpose of this invention is to create an arrangement of the aforementioned type in which two diagonal scorings can be executed at the ends of tubular pieces so that there is a possibility for setting the length of the forward diagonal scored line to incisions on the end with only one pair of scoring rolls.

In accordance with the invention, a cylindrical saucer-type segment of a second scoring tool is retained on each shaft. One segment is provided with a groove in the form of a helix and the other segment is provided with a ridge in the form of a helix. The groove and the ridge engage with each other in the contact region of the cover lines of the external cylinders described by the same.

The arrangement in accordance with the invention is distinguished by the fact that individual sections of the segments carrying the scoring tools can be twisted relative to each other, without being obstructed by the second scoring tool, in order to set a desired length of the forward diagonal scored line.

In accordance with an advantageous configuration, the axial ends of each of the two cylindrical saucer-type segments of the second scoring tool are connected by a radial stay to each hub fastened to the shafts. A part of the former, which projects in an axial sense, overlaps the tings or disks, which can be connected to the shafts, with such rings or disks being connected to the segments carrying the first scoring tools. This configuration easily enables the parts carried by each shaft of the two scoring tools to be located, during their rotation, on a common external cylinder in the manner required.

A particular problem exists in fastening the disks, or segments, which can be twisted with respect to each other in order to set the desired length of the scored line, to the shaft at the correct angle. In order to achieve this, one end hub or end disk can be connected to each shaft in a manner preventing twisting. In order to locate the package of segments that can be twisted, the same can be placed under tension against the hub by a tensioning device. The sole hub or disk, which can be connected to each shaft in a manner preventing twisting, can also carry a segment of the first scoring tool.

In an additional configuration of the invention, each of the two hubs that can be connected, in a manner preventing twisting, to each shaft carries, by a stay, a cylindrical saucer-type segment that features a scoring tool. This segment projects in a direction opposite to the cylindrical saucer-type segments of the second scoring tool.

Each tensioning device can be composed of saucer springs, one side of which is supported by an annular collar of the shaft and the other side of which is supported by a movable bushing mounted on the shaft. The bushing, in turn, is supported by the rings or disks that carry the segments. To lift the tension acting on the rings or disks, in order to twist the same, the bushing can be provided with an annular flange engaged by a rocking arm mounted on the rolling stand. The bushing is moved in the direction of the saucer spring. Each rocking lever can be composed of a double-armed lever that can be swung by a cam plate.

In an additional configuration of the invention, the rings or disks carrying the segments of the first scoring tool are provided with channels, concentric to the shafts, which are engaged by pins mounted to adjacent rings or disks.

It is advantageous for the scoring tools of the segments to be located on a helical line when the pins are located directly against first ends of the channels. In this way, the rings or disks can be aligned relative to each other in a simple and quick manner for the purpose of extending the length of a scored line.

It is preferable for the parts of the scoring tools of both rolls to be divided into segments that can be twisted relative to each other. The segments of both parts of the scoring tools are located in an offset manner with respect to each other in such a way that they cannot engage with each other when the pins are located directly against the other ends of the channels. It is necessary to twist the segments of both cooperating shafts of a scoring tool in this manner when, for example, the two tool parts that execute the diagonal scorings must be brought very close to each other for narrower tubular pieces.

The clearance of the two scored lines situated at right angles to each other can be set only by turning the segments of the first scoring tools. However, the clearance can also be set by connecting the cylindrical saucer-type segments of the second scoring tools to the shafts by means of a detachable clamped joint.

In accordance with an additional preferred embodiment, each shaft is composed of a hollow shaft and a shaft mounted in the hollow shaft. The first scoring tools are mounted or fastened to the hollow shaft and the second scoring tools are fastened to the journals of the shaft. The journals project beyond the hollow shaft. Each shaft and each hollow shaft are provided with toothed gears that separately drive the same. This configuration enables the clearance of the diagonal scored lines from each other to be adjusted or fine-tuned, in a simple manner, by only a relative twisting of the toothed gears.

BRIEF DESCRIPTION OF THE DRAWINGS

An embodiment of the invention is explained in greater detail in the following with the aid of the drawing figures:

FIG. 1 is a diagrammatic representation of a scoring arrangement in accordance with the invention;

FIG. 2 is a top view of the scoring arrangement of FIG. 1 with two workpieces for bags, in which the workpieces consist of tubular parts, and in which a forward end has already been provided with diagonal scored lines;

FIGS. 6*a* to 8*a* are diagrams that correspond to FIGS. 6–8 in which the segments, which can be twisted, of both scoring rolls of the pair of scoring rolls have been set for a narrower workpiece of a bag;

DESCRIPTION OF THE PREFERRED EMBODIMENT

Figure 3:
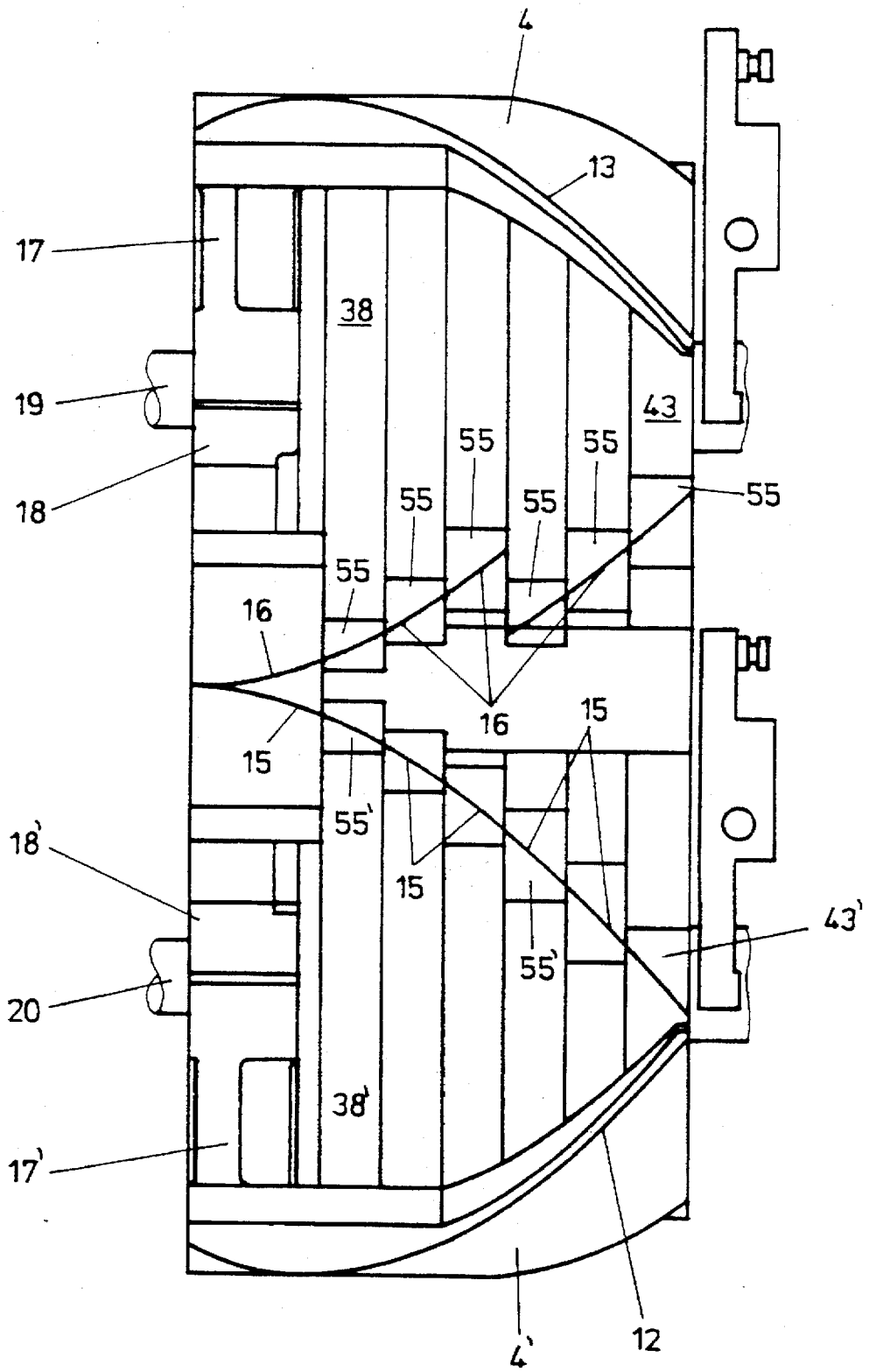
FIG. 3 is an enlarged view of the pair of scoring rolls in the direction of arrow III—III in FIG. 2.

A pair of scoring rolls (1) is evident in side view from FIG. 1. Through the gap between the scoring robs, transverse paper tubular pieces are transported, by a double-belt conveyor (2), for the manufacture of paper bags. The double-belt conveyor (2) is composed of two continuous belts. Between the pair of scoring rolls (1,1') evident from FIG. 2, the belts act upon paper tubular sections (6,6'), transported in a transverse sense such that the ends of the tubular sections that have been provided with cut edges can pass through the gap between the pair of scoring rolls (1,1') for the purpose of being scored.

The pairs of scoring rolls (1,1') are configured to be mirror-images of each other from the transverse center plane. Only one pair of scoring rolls (1), therefore, is described in further detail below.

The upper scoring ton (3) of the pair of scoring tons (1) is of the same fundamental construction as the lower scoring roll (3'), but differs from the lower scoring roll in that the lower scoring roll (3') is provided with helical grooves (female molds) and the upper scoring roll (1) is provided with ridges (male molds) that engage with these grooves in order to form scored lines of prefold lines.

The cut edges (7,7') of tubular pieces (6) of single-ply or multi-ply paper are provided with incisions (8) that are parallel to the forward and follow-up lateral edges. Such incisions, after the sides of the tubular pieces provided with cut edges have been drawn up into bottom squares, lead to the formation of wider lateral tucks or lateral flaps. After being folded over, the triangular pocket-shaped corner tucks lead to improved bottom designs. However, a bottom with a good design is guaranteed only if the later diagonal fold lines of the corner tucks are scored in order to form prefold lines. Consequently, scorings, grooved in cross section, are impressed in flat-lying paper tubular pieces, with such scorings having the tendency to raise the sections of the tubular pieces that have been partitioned off by the scoring. In order to avoid this tendency, the forward sides of tubular pieces transported through the pair of scoring rolls (1,1') in the direction of arrow A are provided only with short diagonal scored lines (9). These short diagonal scored lines start from the forward lateral edge and terminate in the end region of the forward incision (8). If the scored line (9) were to be executed in a continuous manner up to the cut edge (7), then the triangular piece formed by the incision (8) would tend to raise up around the base formed by the scored line such that the cut edge of the triangular piece, formed by the incision (8), would form a hem that would obstruct further processing of the tubular section. This folding out of the triangular piece also cannot be prevented, in the execution of continuous diagonal scored lines, by later providing the incisions (8), since tension generated by providing scored lines cannot be reduced quickly enough.

In contrast, the follow-up diagonal scored line that meets the inner end of the follow-up incision (8) can be continuous up to the cut edge (7), since a possible raising of the triangular piece partitioned off by the scored line (10) does no harm. This is because the incision (8) cannot form a hem with the triangular piece, since the hem follows and is, therefore, pressed down to the plane of the tubular piece when pushing against the triangular piece that has been partitioned off.

The scoring rolls (3,3') of the pair of the scoring rolls (1) are provided with two segments (4,4'; 5,5'), respectively, which form the scoring tools.

Figure 5:
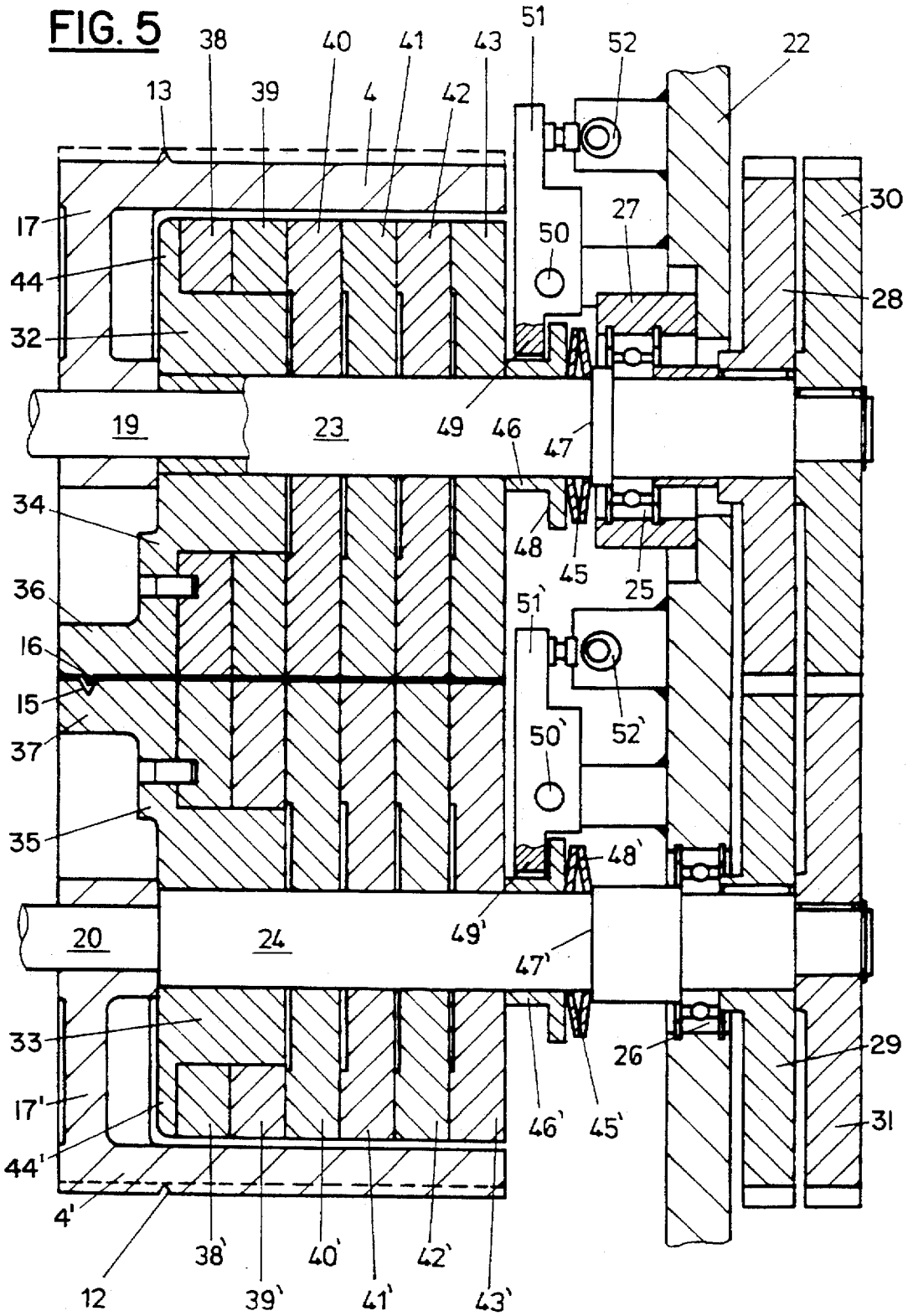
FIG. 5 is a cross section along line IV—IV in FIG. 4.

The scoring rolls (3,3') possess first segments composed of cylindrical saucers (4,4'). One of these first segments (4') is provided with a helical groove (12) and the other of these first segments (4) is provided with a corresponding helical ridge (13) (FIG. 5). The groove and the ridge engage with each other for passage though the gap formed between the scoring rolls.

The scoring rolls (3,3') are provided with additional segments (5,5'). The lower segment of these additional segments is provided with a helical grove (15). The upper segment is provided with a corresponding helical ridge (16). When passing through the gap formed between the rolls, the upper and lower segments engage with each other in a manner evident from FIG. 5.

The first scoring tools formed by segments (5,5') execute short diagonal scored lines (9) which are adjustable in length. Such lines commence at the forward folded edges of the tubular pieces and end in the region of the inner ends of the forward incisions (8). The scoring tools formed by the segments (4,4') execute diagonal scored lines (10), which follow a continuous path from the cut edge (7) to the follow-up folded edge.

The left end regions of the cylindrical shells (4,4') forming the second scoring tools are connected, as shown in FIGS. 3 and 5, by radial stays (17,17') to the shafts (19,20) of the scoring rolls. In order to make this connection, the stays (17,17') are provided with lower jaws having saucer-type recesses. The approximately semicircular profile of each recess has a radius corresponding to the shafts (19,20) of the scoring rolls. Counter jaws (18,18') are provided for clamping to the shafts of the scoring rolls. The counter jaws feature saucer-type recesses identical to those of the lower jaws and, by screws, not shown, along with jaws formed as a unit with the stays (17,17'), can be placed under tension in order to be clamped onto the shafts (19,20) of the scoring rolls. After detaching the straining screws, not shown, the segments (4,4') can be twisted, relative to the segments (5,5'), on the shafts (19,20) of the scoring rolls, in order to set the format and to be placed under tension with the shafts in settings that have been newly set.

The first scoring tools formed by segments (5,5') have a discoid construction. This discoid construction is now explained in greater detail with the aid of FIGS. 3 and 5, which represent a section along line IV—IV in FIG. 4, through a pair of scoring rolls.

Hollow shafts (23,24) are mounted on a lateral wall (22) of the machine rolling stand by roller bearings (25,26). The outer ring of the roller bearing (25) is retained in an eccentric bushing (27) that rotates in the lateral rolling stand (22). By rotating this eccentric bushing, the axle clearance of the shafts (23,24) can be set in order to adjust for tubular sections of different thicknesses. Intermeshing toothed gears (28,29) are fastened by keys to the journals of the hollow shafts (23,24) projecting past the lateral rolling stand (22). The shafts (19,20), to which cylindrical saucer-type segments (4,4') are clamped in the manner described, are mounted in hollow shafts (23,24). Toothed gears (30,31) are fastened by means of keys to the journals of the shafts (19,20). Such journals project past the hollow shafts (23,24).

In normal operation, the toothed gears (28–31) are driven at the same speed. However, in order to change the clearance between the diagonal scored lines (9,10), or in order to precisely fine-me this clearance, a short-term supplemental rotation can be imparted to one of the pairs of toothed gears (28,29;30,31) by, for example, a differential gear. Such a supplemental speed permits the clearance between the diagonal scored fines (9,10) to be changed, for a format switch, without the need to loosen a clamping of the segments (4,4') on the shafts (19,20).

Cylindrical hubs (32,33) are fastened by keys to the inner ends of the hollow shafts (23,24). The cylindrical hubs carry cylindrical saucer-type segments (36,37) by stays (34,35). The outer cover pieces of these segments are provided with a groove (15) and ridge (16). Disks (38,39;38'39') are pushed on the hubs (32,33) and other disks (40–43;40'–43') are pushed on the hollow shafts (23,24). The disks freely rotate relative to each other and are supported by each other. The inner disks (38,38') pushed onto the hubs are supported by annular flanges (44,44') of the hubs. The disks (38–43;38'–43'), which are of equal diameter, are placed under tension with each other by saucer springs (45,45'), and bushings (46,46'). One side of each of the saucer springs (45,45') is supported by the bushings (46,46') and the other side is supported by the flanks (47,47') of annular collars of the hollow shaft. In the setting evident from FIG. 5, disks (38–43;38'–43') are placed under tension with each other, by saucer springs, in such a way that they are retained in a manner preventing a relative rotation. In order to be able to twist the disks relative to each other to set the length of the scored lines (9) in a manner to be described in greater detail in the following, the bushings (46,46') are provided with annular flanges (48,48'), which can be engaged by the shorter lever arms (49,49') of double arm levers pivoted on the lateral rolling stand (22) around axles (50,50'). The longer lever arms (51,51') of the double arm levers can be can be swung by eccentric cams (52,52') pivoted in the lateral rolling stand. If the saucer springs (45,45') are compressed by double-arm rocking arms (49,51;49',51'), then the disks (38–43;38'–43') can be twisted relative to each other.

Figure 10:
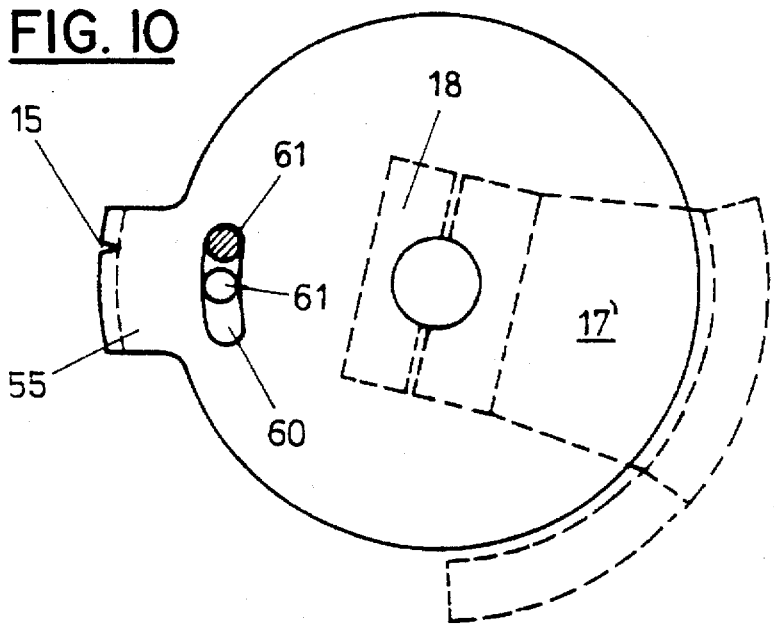
FIG. 10 is a section, through the lower scoring roll, along line IX—IX in FIG. 9.

The disks (38–43;38'–43') carry approximately rectangular segments (55,55') in a manner which is evident from FIGS. 3 and 10 in top view. The approximately rectangular segments (55,55') are provided with ridges (16) and grooves (15). The grooves (15) are located on the same external cylinder as the grooves (12) of the segments (4') and the ridges (16) are located on the same external cylinder as the ridges (13) of the segment (4).

The height of the segments (55,55') is great enough so that the disks that carry the segments can be covered by the projecting parts of the cylindrical saucer-type segments (4,4').

Figure 4:
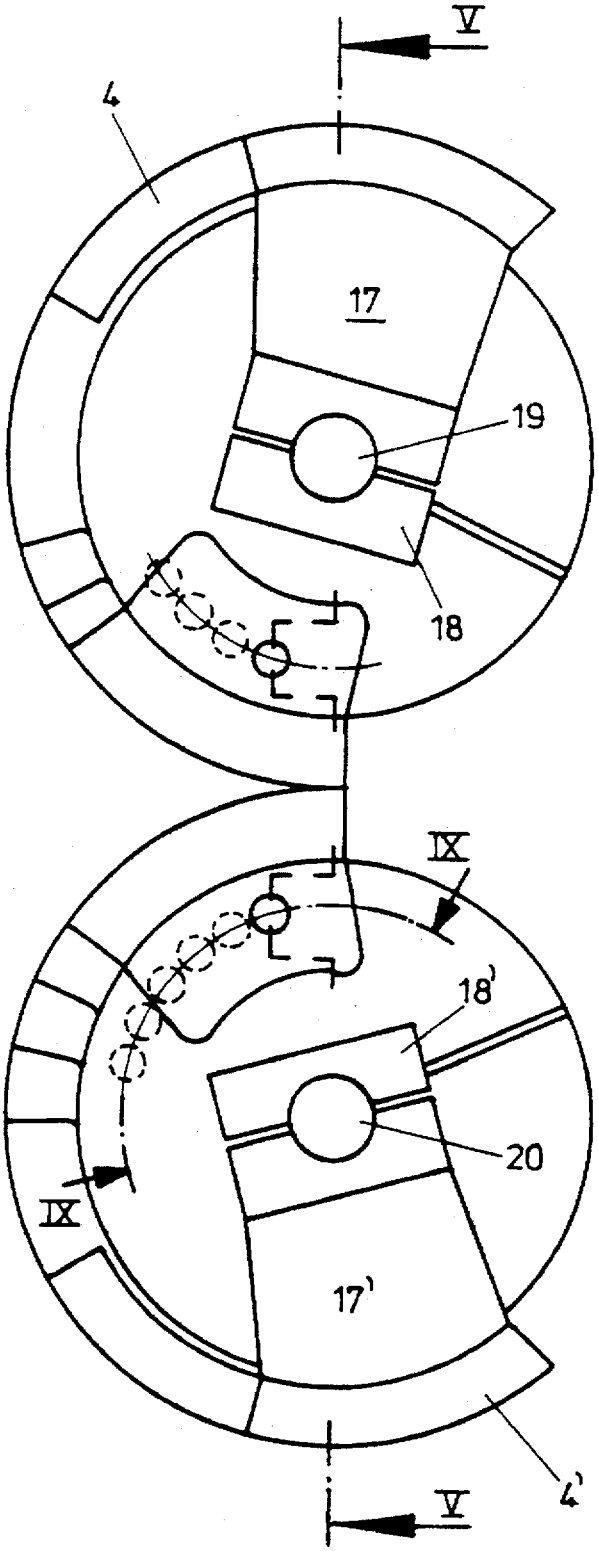
FIG. 4 is an enlarged side view of the pair of scoring rolls in accordance with FIG. 1.
Figure 9:
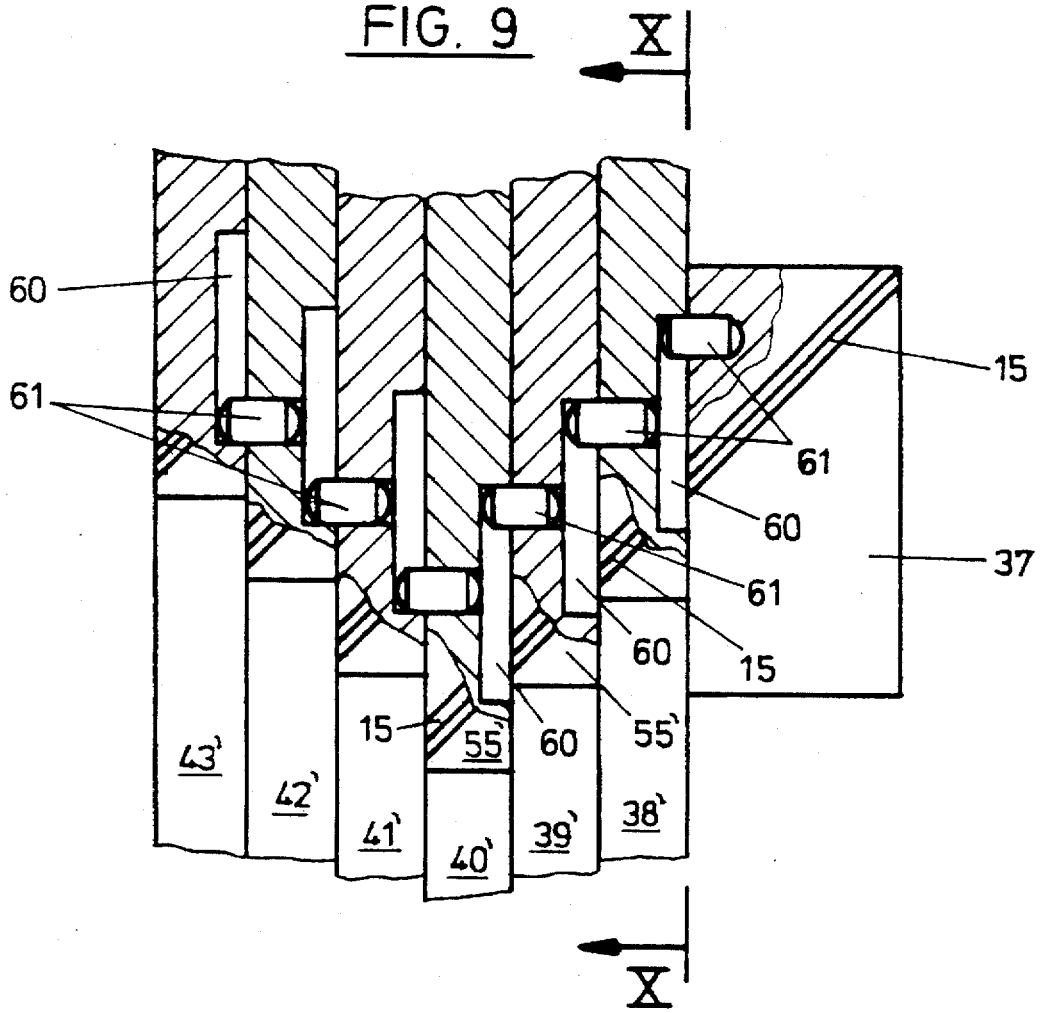
FIG. 9 is a view of one development of a cut, by the lower scoring roll of a pair of scoring rolls, along line IX—IX in FIG. 4.

The disks (38–43;38'–43') are provided with channels (60), in a manner which is evident from FIG. 9, which shows a section through the disks along the line IX–IX in FIG. 4. Pins (61) engage with these channels. Such pins are retained, with a press fit, in bore holes of the adjacent segments (37) or adjacent disks (38'–42'). The lengths of the channels is dimensioned such that the scored grooves (15) or the scored ridges (16) engaging with the same are located on a helical line on the periphery, as is evident from segment (37) and adjacent segments (55') of the disks (38'–40'). For the disks (41'–43'), the pins (61) are located directly against the other ends of the channels (60). The scored groove pieces (15) of the segments (55') are offset with respect to each other, in a stepped manner, as is evident from FIG. 9.

Figure 6:
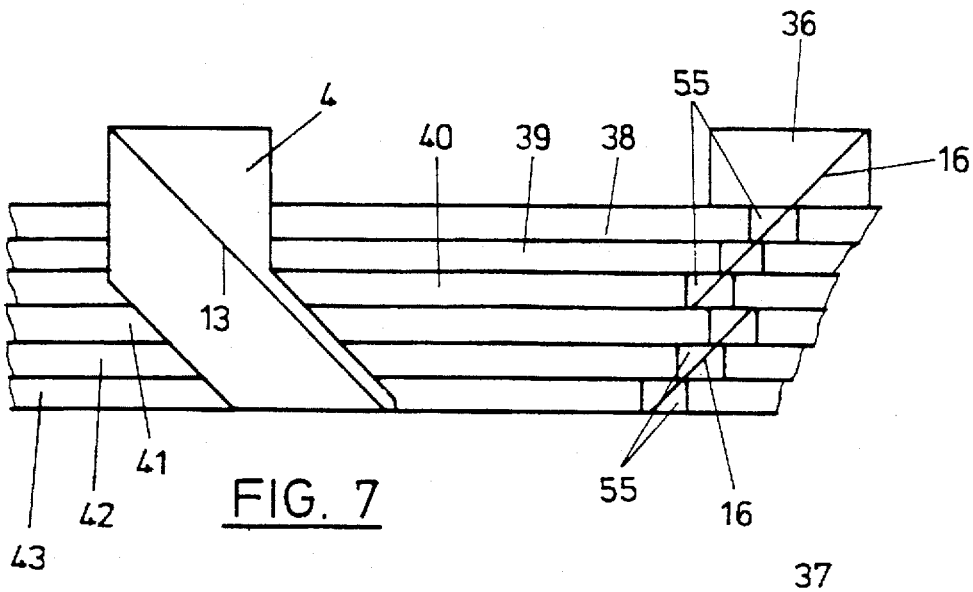
FIG. 6 is a view of one development of the upper scoring roll.
Figure 7:
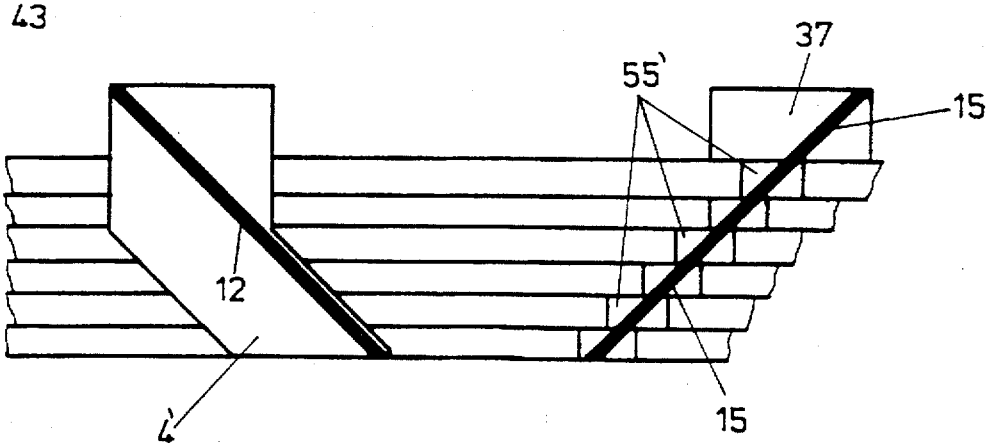
FIG. 7 is a view of one development of the lower scoring roll of the pair of scoring rolls.
Figure 8:
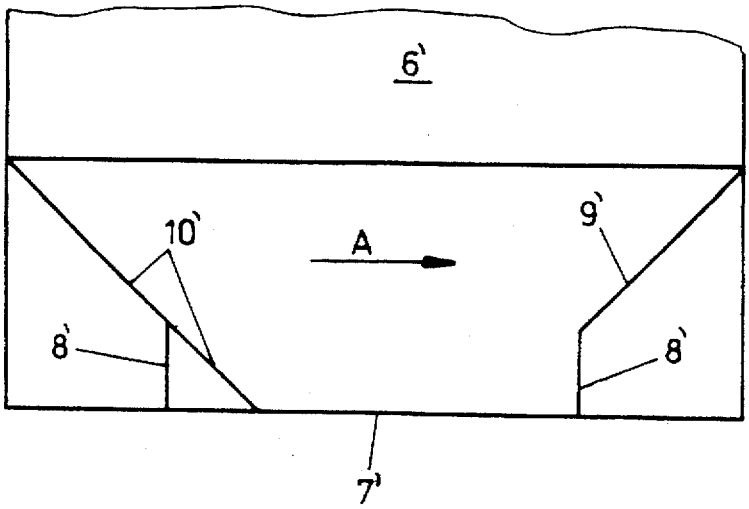
FIG. 8 is a view of a workpiece for a bag, which has passed through the pair of scoring rolls, with scoring caused by setting the pair of scoring rolls in accordance with FIGS. 6 and 7.

The arrangement of the scored lines (9',10') for a tubular section (6') having a greater width is evident from FIG. 8. In this case, scored lines were generated with scoring rolls. The development of the scoring rolls is evident from FIGS. 6 and 7. The shorter scored line (9') is formed by the ridged parts (16), forming a continuous helical line, of the segment (36) and of the segments (55) of the attaching disks (38–49), which engage with the grooves of the segment (37) and of the attaching segments (55) of the disks in the region of the gap between the rolls. The segments (55) of the disks (41–43) are rotated out of the way, in a manner which is evident from FIG. 3, such that they cannot engage with the grooves of segments (55') of the disks (41'–43').

The length of the short scored lines (9') can be set in steps that correspond to the widths of the segments of the disks (38–43), which have been rotated inward.

Figure 6A:
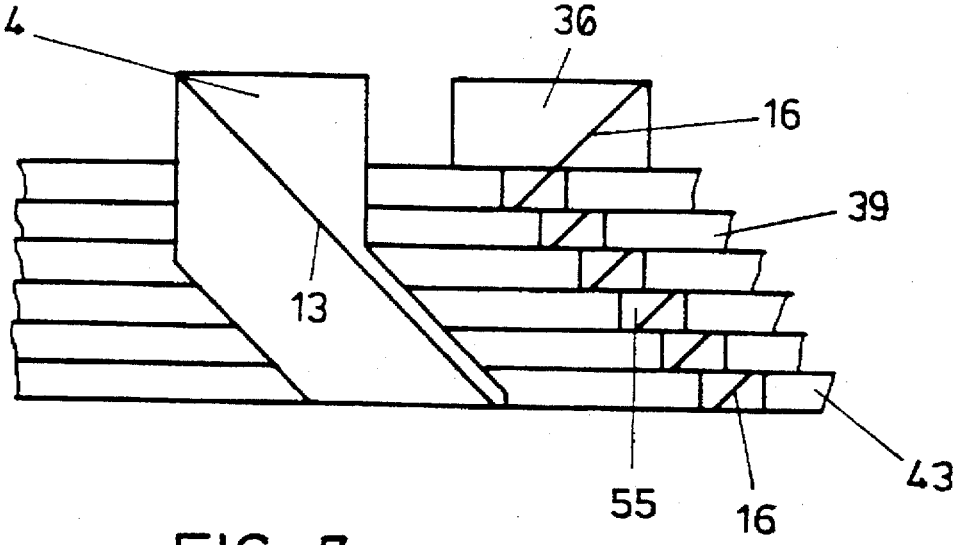
Figure 7A:
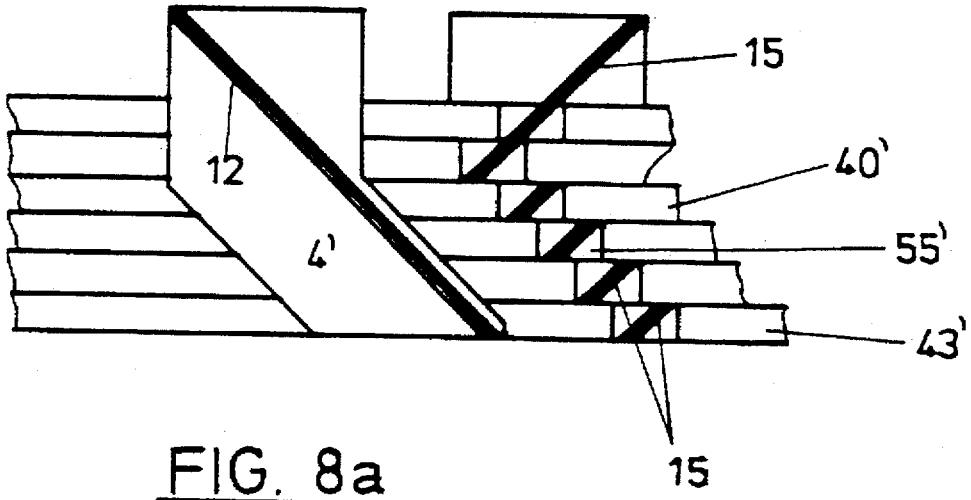
Figure 8A:
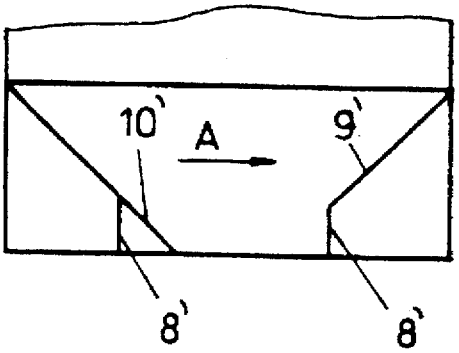

The settings of the disks for providing diagonal scored lines (9',10') on a tubular piece with a smaller width are evident from FIGS. 6*a* and 7*a*. In a case such as this, both the segments (55) of the disks (39–43) as well as the segments (40'–43') must be rotated away with a step-by-step offset, in the manner evident from FIGS. 6*a* and 7*a*, in order for the same to not collide with saucer-type segments (4,4'), angled away in correspondence with the paths of the ridge (13) or groove (12), and to not engage with each other when rotating. The segments (55;55') rotated out of the way in the manner evident from FIG. 6*a* and 7*a*, are located next to each other when passing through the gap between the rolls.

The pattern of the segments (55;55') of the disks (39–43;40'–43'), evident from FIGS. 6*a* and 7*a*, corresponds to the rotational setting of the disks (41'–43') in FIG. 9.

What is claimed is:

1. An arrangement for scoring continuously transported, flat workpieces to be folded along scored lines, in order to provide tubular pieces with prefold lines in a diagonal path and prepare folds of cross bottoms to be attached thereto, comprising:

a pair of shafts that are parallel to each other, a pair of scoring rolls fastened to said shafts, each of said scoring rolls including a first segment and a second segment, the second segment of one of said scoring rolls including a helical groove and the second segment of the other of said scoring rolls including a helical ridge, the groove and the ridge engaging with each other in a contact region, the prefold lines having a length which is set by a group of tightly fitting segments forming each of the second segments and carrying the helical groove and the helical ridge, respectively, at least one segment of at least one of said groups of tightly fitting segments being retained on at least one of the pair of shafts in a pivoting manner and fixable on said at least one of the pair of shafts at different angles, characterized in that the first segment of each of said scoring rolls includes a cylindrical saucer-type segment retained on one of said shafts, one of the cylindrical saucer-type segments being provided with a ridge formed as a helix and the other cylindrical saucer-type segment being provided with a groove formed as a helix, said ridge formed as a helix and said groove formed as a helix engaging with each other in a contact region of external surfaces of the cylindrical saucer-type segments, a radial stay for connecting each of the cylindrical saucer-type segments to a hub fastened to one of the shafts, said cylindrical saucer-type segments protecting in axial directions and overlapping disks, connected to the shafts, upon which the respective group of tightly fitting segments are defined, and a tensioning device on each of the shafts composed of saucer springs, one side of each of the tensioning devices being supported by an annular collar of one of the shafts and the other side of each tensioning device being supported by movable bushings pushed onto the one of the shafts, said movable bushing in turn being supported by one of the groups of tightly fitting segments, each of the movable bushings being provided with an annular flange, engaged by one rocking arm mounted on a rolling frame, which is capable of moving one of the movable bushings towards the saucer springs.

2. The arrangement of claim 1, characterized in that each rocking arm is a double-arm lever which can be pivoted by a cam plate.

3. An arrangement for scoring continuously transported, flat workpieces to be folded along scored lines, in order to provide tubular pieces with prefold lines in a diagonal path and prepare folds of cross bottoms to be attached thereto, comprising:

a pair of shafts that are parallel to each other, a pair of scoring rolls fastened to said shafts, each of said scoring rolls including a first segment and a second segment, the second segment of one of said scoring rolls including a helical groove and the second segment of the other of said scoring rolls including a helical ridge, the groove and the ridge engaging with each other in a contact region, the prefold lines having a length which is set by a group of tightly fitting segments forming each of the second segments and carrying the helical groove and the helical ridge, respectively, at least one segment of at least one said groups of tightly fitting segments being retained on at least one of the pair of shafts in a pivoting manner and fixable on said at least one of the pair of shafts at different angles, characterized in that the first segment of each of said scoring rolls includes a cylindrical saucer-type segment retained on one of said shafts, one of the cylindrical saucer-type segments being provided with a ridge formed as a helix and the other cylindrical saucer-type segment being provided with a groove formed as a helix, said ridge formed as a helix and said groove formed as a helix engaging with each other in a contact region of external surfaces of the cylindrical saucer-type segments, and a radial stay for connecting each of the cylindrical saucer-type segments to a hub fastened to one of the shafts, said cylindrical saucer-type segments projecting in axial directions and overlapping disks, connected to the shafts, upon which the tightly fitting segments are defined, further characterized in that the disks connected to each of the shafts are provided with channels that extend about an arc which is concentric with one of the shafts, said channels being engaged by pins fastened to adjacent disks.

4. The arrangement of claim 3, characterized in that the helical groove and the helical ridge carried by the respective one of the groups of tightly fitting segments are located on a helical line when the pins are located directly against first ends of the channels.

5. The arrangement of claim 4, characterized in that at least one segment of at least one of the groups of tightly fitting segments forming one second segment is offset so that the helical groove and the helical ridge cannot engage with each other when the pins are located directly against second ends of the channels.

* * * * *